US008888613B2

(12) United States Patent
Sato et al.

(10) Patent No.: US 8,888,613 B2
(45) Date of Patent: Nov. 18, 2014

(54) GOLF BALL

(75) Inventors: Katsunori Sato, Chichibushi (JP); Takuma Nakagawa, Chichibushi (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 319 days.

(21) Appl. No.: 13/555,851

(22) Filed: Jul. 23, 2012

(65) Prior Publication Data

US 2014/0024478 A1 Jan. 23, 2014

(51) Int. Cl.
*A63B 37/14* (2006.01)

(52) U.S. Cl.
USPC ..... 473/384

(58) Field of Classification Search
USPC ..... 473/378–385
See application file for complete search history.

(56) References Cited

U.S. PATENT DOCUMENTS

| | | | | |
|---|---|---|---|---|
| 4,681,323 | A * | 7/1987 | Alaki et al. | 473/384 |
| 4,840,381 | A * | 6/1989 | Ihara et al. | 473/365 |
| 6,039,660 | A * | 3/2000 | Kasashima et al. | 473/378 |
| 6,176,793 | B1 * | 1/2001 | Sullivan et al. | 473/378 |
| 6,315,686 | B1 * | 11/2001 | Barfield | 473/383 |
| 6,475,106 | B1 * | 11/2002 | Green et al. | 473/383 |
| 6,796,912 | B2 * | 9/2004 | Dalton et al. | 473/383 |
| 6,899,643 | B2 * | 5/2005 | Sajima et al. | 473/383 |
| 6,986,720 | B2 * | 1/2006 | Sajima et al. | 473/383 |
| 7,163,472 | B2 * | 1/2007 | Dalton et al. | 473/383 |
| 7,201,674 | B2 * | 4/2007 | Ohama et al. | 473/383 |
| 7,252,602 | B2 * | 8/2007 | Sajima et al. | 473/383 |
| 7,261,649 | B2 | 8/2007 | Ohama et al. | |
| 7,261,650 | B2 | 8/2007 | Ohama et al. | |
| 7,291,077 | B2 * | 11/2007 | Sajima | 473/383 |
| 7,354,358 | B2 * | 4/2008 | Kasashima et al. | 473/383 |
| 7,641,572 | B2 * | 1/2010 | Aoyama et al. | 473/383 |

FOREIGN PATENT DOCUMENTS

| | | | |
|---|---|---|---|
| JP | 11-57065 | A | 3/1999 |
| JP | 2005-342407 | A | 12/2005 |
| JP | 2006-149929 | A | 6/2006 |
| JP | 2006-158778 | A | 6/2006 |
| JP | 2006-187476 | A | 7/2006 |
| JP | 2006-187485 | A | 7/2006 |
| JP | 2008-93481 | A | 4/2008 |

* cited by examiner

*Primary Examiner* — Alvin Hunter
(74) *Attorney, Agent, or Firm* — Sughrue Mion, PLLC

(57) ABSTRACT

The invention provides a golf ball with a surface having a plurality of dimples formed thereon. Some or all of the dimples on the ball surface have a cross-sectional shape in which, letting a straight line passing through any one edge of the dimple and a foot of a perpendicular (pedal) dropped from an imaginary plane defined by a peripheral edge of the dimple to a deepest point of the dimple serve as a reference line, and establishing a plurality of specific regions on the reference line from the dimple edge as 0% to the pedal as 100%, the average depths of the dimple from the reference line in the respective established regions satisfy specific conditions. By reducing the air resistance during flight and thus enhancing the aerodynamic performance, this golf ball achieves a higher trajectory, enabling the ball to travel further.

3 Claims, 6 Drawing Sheets

GOLF BALL

BACKGROUND OF THE INVENTION

The present invention relates to a golf ball having a plurality of dimples formed on the ball surface. More specifically, the invention relates to a golf ball whose aerodynamic performance has been enhanced by optimizing the cross-sectional shape of dimples formed on the ball surface.

To improve the distance traveled by a golf ball, it is important to increase the rebound of the ball and to reduce the air resistance during flight by means of dimples formed on the ball surface and thus improve the aerodynamic performance. This fact is generally well known, which is why, for example, many golfers use golf balls on which have been formed numerous dimples that are circularly arcuate in cross-section as shown in FIG. 5. In order to further enhance the aerodynamic performance of the ball, various disclosures concerning the dimple shape and the method of configuring the dimples have hitherto been made in, for example, JP-A 11-57065, JP-A 2005-342407, JP-A 2006-149929, JP-A 2006-158778, JP-A 2006-187476, JP-A 2006-187485 and JP-A 2008-93481.

Hence, developing a golf ball which enables more golfers to obtain a satisfactory flight performance is important for expanding the golfer base, and further improvement in the aerodynamic performance of the ball is indispensable for achieving a better flight performance.

SUMMARY OF THE INVENTION

It is therefore an object of the present invention to provide a golf ball which is able to further increase the aerodynamic performance of the ball and enhance the flight performance.

As a result of extensive investigations, the inventors have discovered that, when deciding on the cross-sectional shape of a dimple, it is possible to obtain a characteristic cross-sectional shape by dividing the interior of the dimple into a plurality of specific regions and quantifying the dimple interior in such a way that the average depth in each region satisfies a specific relationship, and have found that such a cross-sectional shape is effective for stabilizing the dimple effects during ball flight and enhancing the aerodynamic performance of the ball.

Accordingly, the invention provides the following golf balls.

[1] A golf ball comprising a surface having a plurality of dimples formed thereon, wherein some or all of the dimples formed on the ball surface are dimples having a cross-sectional shape which, letting a straight line passing through any one edge of the dimple and a foot of a perpendicular (pedal) dropped from an imaginary plane defined by a peripheral edge of the dimple to a deepest point of the dimple serve as a reference line, establishing the following regions (1) to (5) on the reference line from the dimple edge as 0% (origin) to the pedal as 100%:

(1) 11% to 30%, (2) 31% to 50%, (3) 51% to 70%, (4) 71% to 90%, and (5) 81% to 100%, and letting the dimple have average depths d1 to d5 from the reference line in the respective regions (1) to (5), satisfies the following conditions:

$$d1 \div d5 = 25\% \text{ to } 100\%,$$

$$d2 \div d5 = 0\% \text{ to } 55\%,$$

$$d3 \div d5 = 60\% \text{ to } 100\%, \text{ and}$$

$$d1 \div d2 = 0\% \text{ to } 90\%.$$

[2] The golf ball according to [1], wherein the dimples having cross-sectional shapes which satisfy said conditions account for at least 20% of the total number of dimples formed on the ball surface.

[3] The golf ball according to [1] which has formed thereon two or more types of dimples of mutually differing diameter and/or depth.

(As used here in the foregoing context, the phrase "diameter and/or depth" means that the two or more types of dimples may be dimples which differ in diameter alone, dimples which differ in depth alone, or dimples which differ in both diameter and depth.)

BRIEF DESCRIPTION OF THE DIAGRAMS

DETAILED DESCRIPTION OF THE INVENTION

The golf ball is described in detail below while referring to the attached diagrams.

Figure 1A:
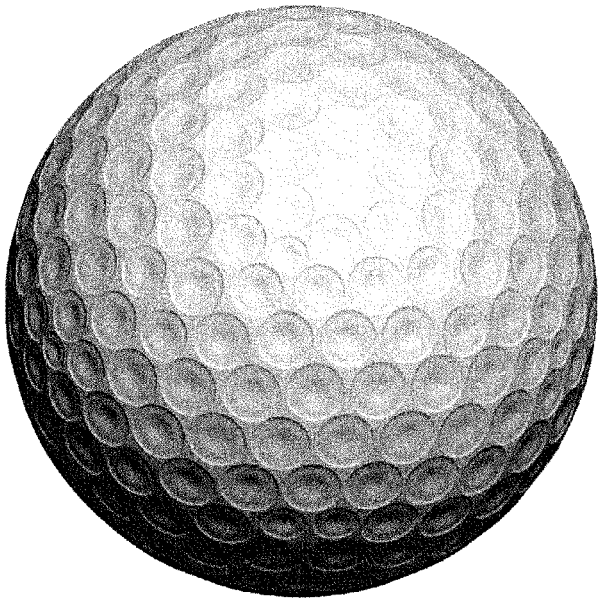
FIG. 1A is a plan view showing the outward appearance of a golf ball according to one embodiment of the invention.
Figure 1B:
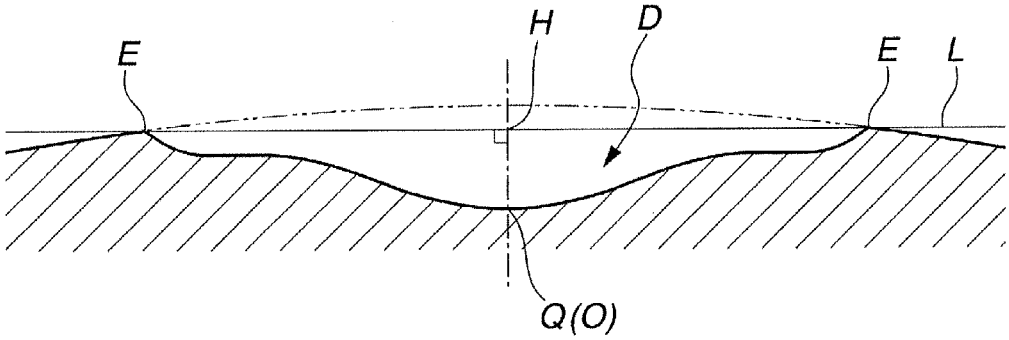
FIG. 1B is an enlarged cross-sectional view of one of the dimples formed on the surface of the golf ball shown in FIG. 1A.

FIG. 1A is a plan view showing the outward appearance of a golf ball according to one embodiment of the invention, and FIG. 1B is an enlarged cross-sectional view of one of the dimples formed on the surface of the golf ball shown in FIG. 1A. In these diagrams, the symbol D represents a dimple, E, E represent edges of the dimple, Q represents a deepest point of the dimple, the straight line L represents a reference line which passes through the dimple edges E and a foot H of a perpendicular (referred to below as "the pedal H") dropped from an imaginary plane defined by a peripheral edge of the dimple D to the deepest point Q of the dimple D, and the dashed line represents an imaginary spherical surface. The dimple edges E, E are boundaries between the dimple D and regions (lands) on the ball surface where dimples D are not formed, and correspond to points where the imaginary spherical surface is tangent to the ball surface (the same applies below). The dimple shown in FIG. 1 is a circular dimple as seen from above; a center O of the dimple coincides with the deepest point Q.

A proper understanding of the invention takes precedence in apprehending the cross-sectional shape of the dimple shown in FIG. 1B, which is not drawn to scale. The same applies also to the cross-sectional shapes of the dimples shown subsequently in FIGS. 2, 3, 4B, 5B, 6B and 7.

In the invention, it is critical for the cross-sectional shape of the dimple D to satisfy the following conditions. These conditions are explained below.

First, on a portion of the reference line L from the dimple edge E to the pedal H, letting the dimple edge E be 0% (origin) and the pedal H be 100%, the following regions (1) to (5) are established:

(1) 11% to 30%,
(2) 31% to 50%,
(3) 51% to 70%,
(4) 71% to 90%, and
(5) 81% to 100%.

Figure 2:
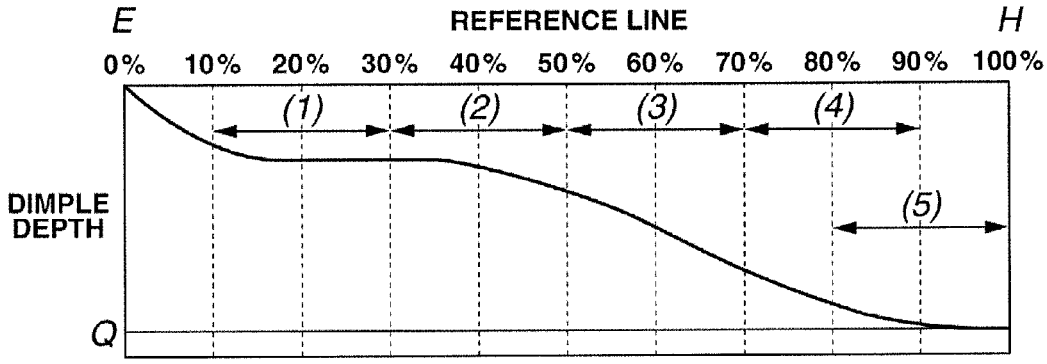
FIG. 2 is a diagram showing the relationship between the cross-section of the dimple shown in FIG. 1B and the regions established at the interior of the dimple.

Here, any one edge of the dimple may be suitably selected without particular limitation as the dimple edge E. FIG. 2 shows the relationship between above regions (1) to (5) and the dimple cross-section.

Next, the average depth d1 from the reference line L in region (1), the average depth d2 from the reference line L in region (2), the average depth d3 from the reference line L in region (3), the average depth d4 from the reference line L in region (4), and the average depth d5 from the reference line L in region (5) are calculated. At this time, although not subject to any particular limitation, from the standpoint of determining the average depth of each region to a higher accuracy, it is recommended that the average depth of each region be calculated after first determining the depths at preferably at least 100 equally spaced points in the interval from the dimple edge E to the pedal H. The aforementioned average depths d1 to d5 refer to arithmetic averages of the depths measured at each of the above points, which measured values are obtained before paint is applied to the ball surface.

It is critical for the average depths of the respective above regions to satisfy the following conditions:

$$d1 \div d5 = 25\% \text{ to } 100\%,$$

$$d2 \div d5 = 0\% \text{ to } 55\%,$$

$$d3 \div d5 = 60\% \text{ to } 100\%, \text{ and}$$

$$d1 \div d2 = 0\% \text{ to } 90\%.$$

In the present invention, by having the average depths of the respective regions satisfy the above relationships, the air resistance during flight decreases, enabling the aerodynamic properties to be improved.

Preferred lower limit values and upper limit values for each of the above parameters are given below.

The value of d1÷d5 has a preferred lower limit of at least 27%. The upper limit of this value is preferably not more than 49.5%, more preferably not more than 40%, and even more preferably not more than 35%.

The value of d2÷d5 has a preferred lower limit of at least 30%. This value has a preferred upper limit of not more than 44%.

The value of d3÷d5 has a preferred lower limit of at least 61%. The upper limit of this value is preferably not more than 90%, and more preferably not more than 80%.

The value of d1÷d2 has a lower limit of preferably at least 50%, and more preferably at least 69%. This value has a preferred upper limit of not more than 88%.

The range in the value of d4÷d5, although not particularly limited, is preferably set to from 70% to 100%. The value of d4÷d5 has a lower limit of preferably at least 80%, and more preferably at least 85%. This value has a preferred upper limit of not more than 99%.

Dimples that are circular as seen from above are depicted in FIG. 1 by way of illustration, although the dimple shape (as seen from above) is not limited to a circular shape. Dimples of other shapes, such as polygonal, teardrop or elliptical dimples, may be suitably selected. It is possible, even with dimples of non-circular shape, to set the cross-sectional shape by a method similar to that indicated above. In the example shown in FIG. 1, the center O of the dimple and the deepest point Q coincide. However, the deepest point Q does not necessarily have to coincide with the center O of the dimple. Even in cases where the center O and the deepest point Q of the dimple D do not coincide, this does not pose any particular problem; the cross-sectional shape can be set by establishing regions (1) to (5) and calculating the average depths d1 to d5 of each region in the same way as described above.

Figure 3:
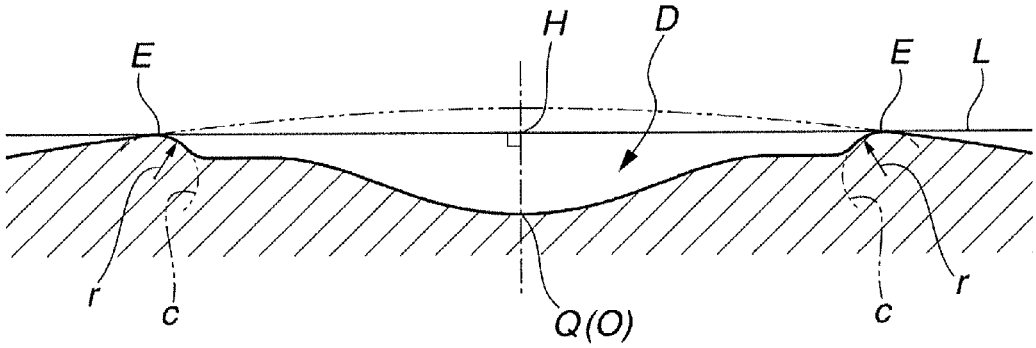
FIG. 3 is an enlarged cross-sectional view showing another form of the dimple cross-sectional shape.

The cross-sectional shape of the dimple D is illustrated in FIG. 1 by a shape composed primarily of a gently curved line and including straight lines in portions thereof, but is not limited thereto, and may instead be a shape composed primarily of straight lines and including gently curved lines in portions thereof, or a shape composed entirely of gently curved lines or entirely of straight lines. Alternatively, this cross-sectional shape may be a shape which, as shown in FIG. 3, includes in portions thereof circular arcs c of a given radius of curvature r near the dimple edges E, E.

The diameter of the dimple D (in polygonal dimples, the diagonal length), although not particularly limited, may be set to preferably at least 2 mm, and more preferably at least 2.5 mm. There is no particular upper limit, although the dimple diameter is set to preferably not more than 8 mm, and more preferably not more than 7 mm.

The depth at the deepest point Q of the dimple D, although not particularly limited, may be set to preferably from 0.05 to 0.5 mm, and more preferably from 0.1 to 0.4 mm.

The method of configuring the dimples is not particularly limited, although preferred use may be made of a method which uses a geometrically configured pattern in the form of a regular polyhedron such as a regular octahedron, a regular dodecahedron or a regular icosahedron, or a method that involves configuring the dimples with rotational symmetry about the poles of the ball, such as three-fold symmetry, four-fold symmetry, five-fold symmetry or six-fold symmetry.

The total number of dimples formed on the ball surface, although not particularly limited, may be set to preferably at least 100, and more preferably at least 250. There is no particular upper limit, although the total number of dimples may be set to preferably not more than 500, and more preferably not more than 450.

In the practice of the invention, the dimples having the above-described cross-sectional shape may account for some or all of the dimples formed on the ball surface.

Figure 5A:
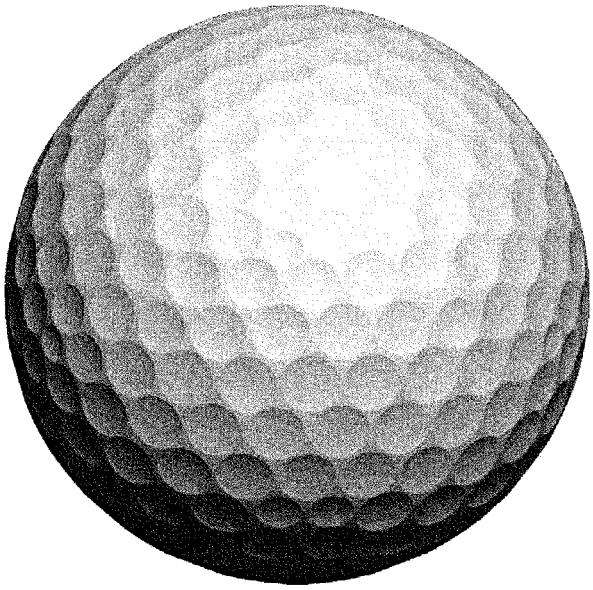
FIG. 5A is a plan view showing the outward appearance of a golf ball on which have been formed conventional dimples with cross-sectional shapes that are circularly arcuate.
Figure 5B:
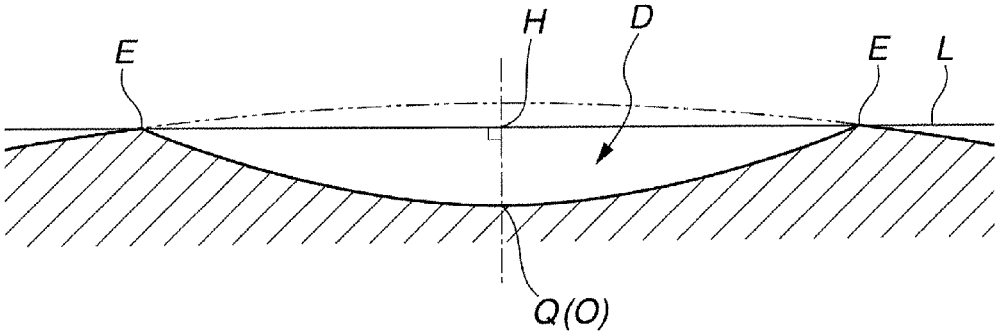
FIG. 5B is an enlarged cross-sectional view of one of the dimples formed on the surface of the golf ball shown in FIG. 5A.

Accordingly, in this invention, it is not necessary for all the dimples formed on the ball surface to be dimples having the above-described cross-sectional shape. For example, conventional dimples like those shown in FIG. 5 may be interspersed among the dimples having the above cross-sectional shape. In such a case, the dimples having the above-described cross-sectional shape account for a proportion of the total number of dimples formed on the ball surface which, although not subject to any particular limitation, may be set to 20% or more, preferably 50% or more, more preferably 80% or more, and even more preferably 100%.

In the invention, although not subject to any particular limitation, it is recommended that preferably at least two types, and more preferably at least three types, of dimples of mutually differing diameter and/or depth be formed. Even in cases where dimples which do not satisfy the above conditions are included, if such dimples include ones that are of mutually differing diameter and/or depth, they shall be regarded as differing types of dimples.

The sum of the volumes of the individual dimple spaces formed below a flat plane circumscribed by the edge of each dimple, expressed as a ratio VR (dimple spatial occupancy) with respect to the volume of an imaginary sphere were the ball surface assumed to have no dimples thereon, although not subject to any particular limitation, may be set to generally at least 0.7%, preferably at least 0.75%, and more preferably at least 0.8%. There is no particular upper limit in the ratio VR, although this value may be set to 1.5% or less, preferably 1.45% or less, and more preferably 1.4% or less. By setting the dimple spatial occupancy VR in the above range, when the ball is struck with a distance club such as a driver, the shot can be prevented from rising too steeply or from dropping without gaining enough height.

To fabricate a mold for molding the above golf ball, a technique may be employed in which 3D CAD/CAM is used to directly cut the entire surface shape three-dimensionally into a master mold from which the golf ball mold is subsequently made by pattern reversal, or to directly cut three-dimensionally the cavity (inside walls) of the golf ball mold.

As with ordinary golf balls, various types of coating, such as white enamel coating, epoxy coating or clear coating, may be carried out on the ball surface. In this case, evenly and uniformly coating the surface is preferred in order to avoid marring the cross-sectional shape of the dimples.

Figure 7:
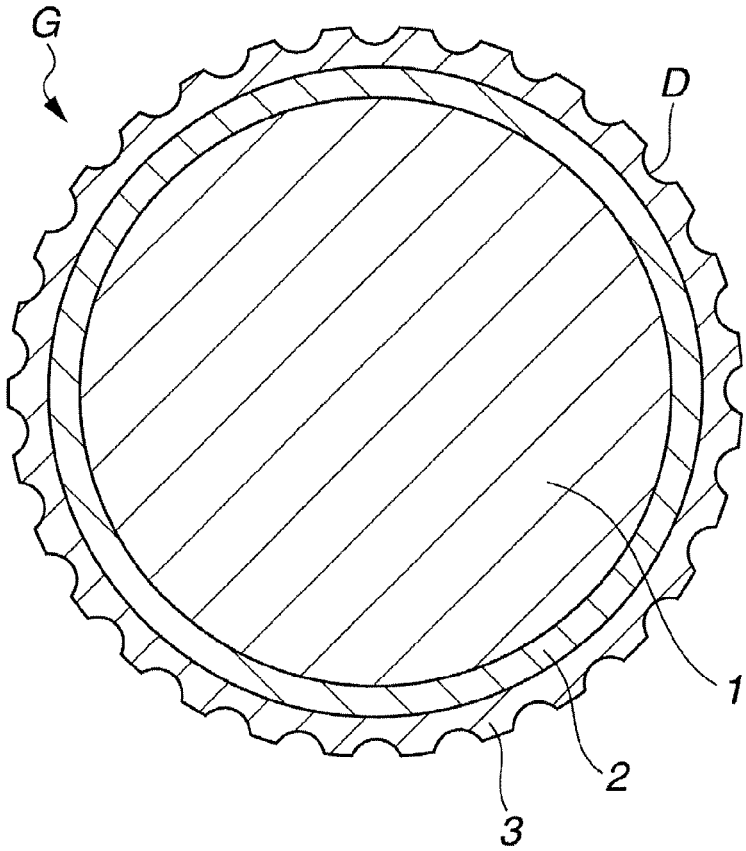
FIG. 7 is a schematic cross-sectional view showing an example of the structure of the inventive golf ball.

The golf ball of the invention is not subject to any particular limitation with regard to the internal construction. That is, the present art may be applied to any type of golf ball, including solid golf balls such as one-piece golf balls, two-piece golf balls, and multi-piece golf balls having a construction of three or more layers, and also wound golf balls. Referring to FIG. 7, the use of a multi-piece solid golf ball G in which an intermediate layer 2 composed of one, two or more layers is formed between a solid core 1 and a cover 3 is especially preferred. In FIG. 7, the symbol D represents a dimple.

Although not subject to any particular limitation, in the golf ball G shown in FIG. 7, the solid core 1 is preferably formed primarily of polybutadiene. Also, the solid core 1 has a deflection when compressed under a final load of 1,275 N (130 kgf) from an initial load of 98 N (10 kgf) which, although not particularly limited, may be set to at least 2.0 mm. There is no particular upper limit in the deflection, although the deflection may be set to 6.0 mm or less.

The materials used in the intermediate layer 2 and the cover 3 are not subject to any particular limitation. Preferred use may be made of, for example, known ionomer resins, thermoplastic elastomers and thermoset elastomers. Exemplary thermoplastic elastomers include polyester-type, polyamide-type, polyurethane-type, olefin-type and styrene-type thermoplastic elastomers.

The material hardness of the intermediate layer, although not subject to any particular limitation, may be set to a Shore D hardness of generally at least 30. This material hardness has no particular upper limit, although the Shore D hardness may be set to generally 75 or less.

The material hardness of the cover, although not subject to any particular limitation, may be set to a Shore D hardness of generally at least 30. This material hardness has no particular upper limit, although the Shore D hardness may be set to typically 75 or less.

Here, the above material hardnesses are values obtained by using a molding press to mold the material into sheets having a thickness of 2 mm, stacking the molded sheets to a thickness of at least 6 mm, and measuring the hardness in accordance with ASTM D2240 with a type D durometer.

The thickness of the intermediate layer and the thickness of the cover, although not subject to any particular limitation, are each preferably set in the range of 0.3 to 3.0 mm. Ball parameters such as the ball weight and diameter may be suitably set in accordance with the Rules of Golf.

As described above, in the golf ball of the invention, by forming on the surface dimples having a characteristic cross-sectional shape, the air resistance during flight is reduced, which improves the aerodynamic performance of the ball and thus enables a higher trajectory to be obtained. As a result, the distance traveled by the ball, especially the carry, can be further increased.

EXAMPLES

Examples of the invention and Comparative Examples are given below by way of illustration, although the invention is not limited by the following Examples.

Examples 1 and 2, and Comparative Examples 1 and 2

Figure 4A:
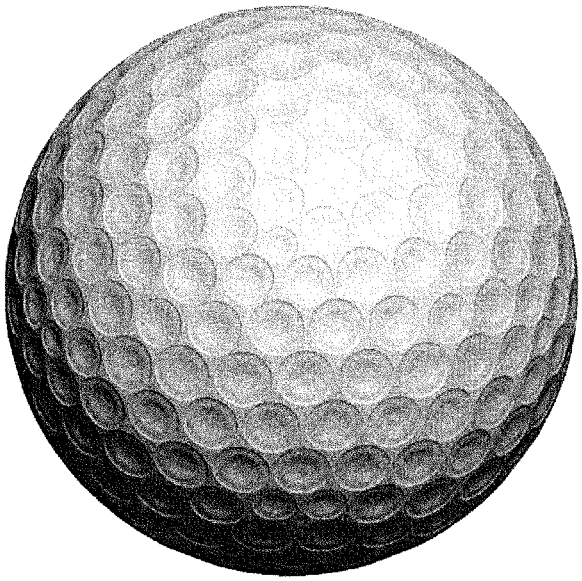
FIG. 4A is a plan view showing the outward appearance of a golf ball according to another embodiment of the invention.
Figure 4B:
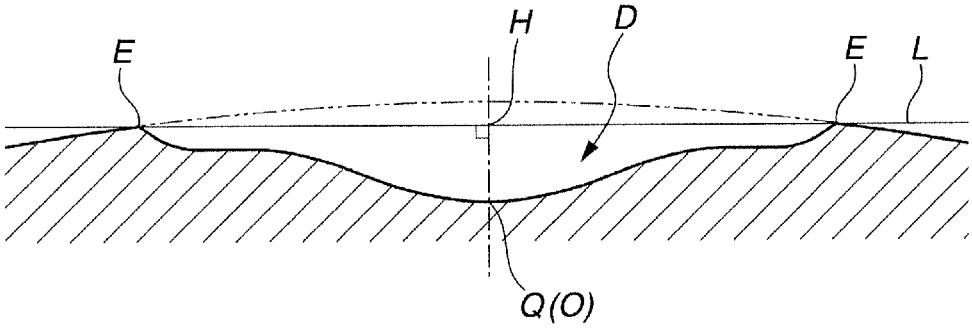
FIG. 4B is an enlarged cross-sectional view of one of the dimples formed on the surface of the golf ball shown in FIG. 4A.
Figure 6A:
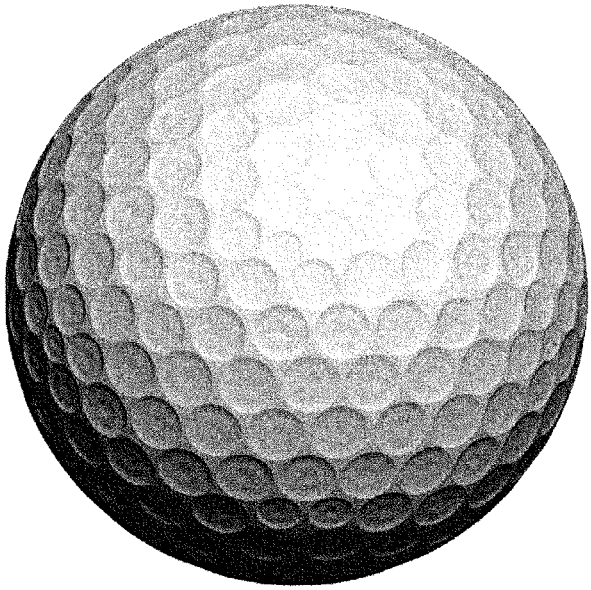
FIG. 6A is a plan view showing the outward appearance of a golf ball on which have been formed conventional double dimples.
Figure 6B:
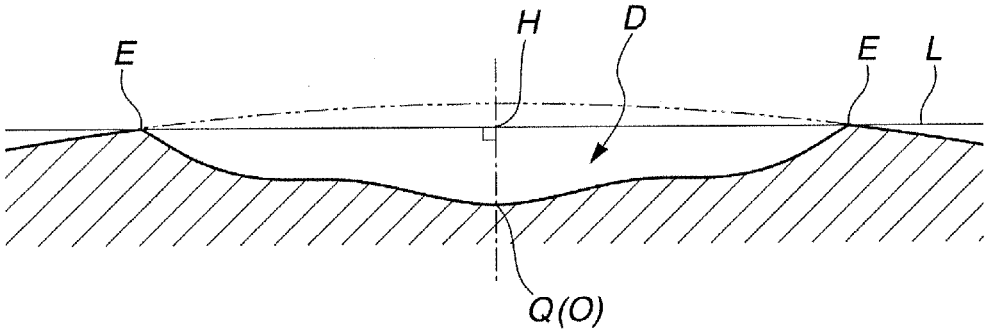
FIG. 6B is an enlarged cross-sectional view of one of the dimples formed on the surface of the golf ball shown in FIG. 6A.

Golf balls with dimples formed thereon having the cross-sectional shapes shown in Example 1 (FIG. 1), Example 2 (FIG. 4), Comparative Example 1 (FIG. 5, conventional dimples that are circularly arcuate in cross-section) and Comparative Example 2 (FIG. 6, conventional double dimples) were manufactured, and the flight properties were compared. Details on the dimples in each of these examples are shown in Tables 1 to 4.

The depths from a reference line to the dimple inside surface were measured at 100 equally spaced points along the reference line from the dimple edge to the pedal, and the average depths d1 to d5 in regions (1) to (5) were calculated. That is, the above average depths d1 to d5 are each an arithmetic average of the depths at 20 points measured within the respective regions. The dimples were configured in the same pattern in all of the examples.

With regard to the interior construction of the golf balls in these respective examples, as shown in FIG. 7, the ball had a three-layer construction composed of a core 1, an intermediate layer 2 and a cover 3. Details on each of these layers are given below.

Core

A rubber composition containing 80 parts by weight of polybutadiene A (available from JSR Corporation under the product name BR51), 20 parts by weight of polybutadiene B (available from JSR Corporation under the product name BR11), 28.5 parts by weight of zinc acrylate, 1.2 parts by weight of a mixture of 1,1-di(t-butylperoxy)cyclohexane and silica (available from NOF Corporation under the product name Perhexa C-40), 4 parts by weight of zinc oxide, 19.1 parts by weight of Barium Sulfate 300 (available from Sakai Chemical Co., Ltd.), 0.1 part by weight of an antioxidant (available from Ouchi Shinko Chemical Industry under the product name Nocrac NS-6) and 0.1 part by weight of the zinc salt of pentachlorothiophenol was prepared. The resulting rubber composition was then molded and vulcanized in a core mold at vulcanization conditions of 155° C. and 13 minutes, thereby producing solid cores having a diameter of 37.7 mm. The resulting solid cores had a deflection, as measured following compression under a final load of 1,275 N (130 kgf) from an initial load of 98 N (10 kgf), of 3.6 mm.

Intermediate Layer and Cover

Using the intermediate layer material described below, an intermediate layer having a thickness of 1.7 mm was formed by an injection molding process over the cores obtained as described above. Next, using the cover material described below, a cover having a thickness of 0.8 mm was formed by an injection molding process, thereby producing three-piece solid golf balls having a diameter of 42.7 mm and a weight of 45.4 g. Dimples were formed on the ball surface at the same time as the cover was molded. The intermediate layer material was a resin composition obtained by formulating Himilan 1605 (an ionomer resin available from DuPont-Mitsui Polychemicals), Himilan 1557 (an ionomer resin available from DuPont-Mitsui Polychemicals), Himilan 1706 (an ionomer resin available from DuPont-Mitsui Polychemicals) and trimethylolpropane in a weight ratio of 50/15/35/1.1. The cover material was a resin composition obtained by formulating Pandex T-8295 (a polyurethane thermoplastic elastomer available from DIC Bayer Polymer), titanium oxide, Sanwax 161P (a polyethylene wax available from Sanyo Chemical Industries) and an isocyanate compound (4,4'-diphenylmethane diisocyanate) in a weight ratio of 100/3.5/1/7.5. The Shore D material hardnesses of the intermediate layer material and the cover material were respectively 62 and 47.

Performance Test

A driver (W#1) was set on a swing robot, and both the height attained at the top of the trajectory and the distance (carry) of the ball when struck were measured. The striking conditions were set as follows: initial ball velocity, about 65 m/s; launch angle, about 10°; initial backspin, about 2,700 rpm. The club used was a TourStage X-Drive 701 (loft, 9°) manufactured by Bridgestone Sports Co., Ltd. The measured results are shown in Tables 1 to 4.

TABLE 1

| | | Example 1 | | | | |
|---|---|---|---|---|---|---|
| Dimple type | | No. 1 | No. 2 | No. 3 | No. 4 | No. 5 |
| Number of dimples | | 18 | 228 | 60 | 18 | 6 |
| Diameter (mm) | | 4.5 | 4.3 | 3.8 | 3.3 | 2.7 |
| Depth at point of maximum depth (mm) | | 0.200 | 0.210 | 0.200 | 0.175 | 0.170 |
| Average depths[1] | d1 (mm) | 0.059 | 0.062 | 0.059 | 0.052 | 0.050 |
| | d2 (mm) | 0.070 | 0.073 | 0.070 | 0.061 | 0.059 |
| | d3 (mm) | 0.120 | 0.126 | 0.120 | 0.105 | 0.102 |
| | d4 (mm) | 0.176 | 0.185 | 0.176 | 0.154 | 0.150 |
| | d5 (mm) | 0.193 | 0.202 | 0.193 | 0.169 | 0.164 |
| d1 ÷ d5 (%) | | 31 | 31 | 31 | 31 | 31 |
| d2 ÷ d5 (%) | | 36 | 36 | 36 | 36 | 36 |
| d3 ÷ d5 (%) | | 62 | 62 | 62 | 62 | 62 |
| d4 ÷ d5 (%) | | 91 | 91 | 91 | 91 | 91 |
| d1 ÷ d2 (%) | | 84 | 84 | 84 | 84 | 84 |
| VR (%) | | | | 0.833 | | |
| Ratio[2] (%) | | | | 100 | | |
| Highest point attained (m) | | | | 23.5 | | |
| Carry (m) | | | | 216.8 | | |

[1]Values are rounded off to nearest thousandth of a millimeter.

[2]The proportion of the total number of dimples formed on the ball surface which are dimples that satisfy the conditions specified in the invention.

TABLE 2

| | | Example 2 | | | | |
|---|---|---|---|---|---|---|
| Dimple type | | No. 1 | No. 2 | No. 3 | No. 4 | No. 5 |
| Number of dimples | | 18 | 228 | 60 | 18 | 6 |
| Diameter (mm) | | 4.5 | 4.3 | 3.8 | 3.3 | 2.7 |
| Depth at point of maximum depth (mm) | | 0.165 | 0.180 | 0.170 | 0.150 | 0.170 |
| Average depths[1] | d1 (mm) | 0.049 | 0.053 | 0.050 | 0.044 | 0.050 |
| | d2 (mm) | 0.070 | 0.076 | 0.072 | 0.063 | 0.072 |
| | d3 (mm) | 0.129 | 0.140 | 0.132 | 0.117 | 0.132 |
| | d4 (mm) | 0.161 | 0.176 | 0.166 | 0.147 | 0.166 |
| | d5 (mm) | 0.165 | 0.180 | 0.170 | 0.150 | 0.170 |
| d1 ÷ d5 (%) | | 29 | 29 | 29 | 29 | 29 |
| d2 ÷ d5 (%) | | 42 | 42 | 42 | 42 | 42 |
| d3 ÷ d5 (%) | | 78 | 78 | 78 | 78 | 78 |
| d4 ÷ d5 (%) | | 98 | 98 | 98 | 98 | 98 |
| d1 ÷ d2 (%) | | 70 | 70 | 70 | 70 | 70 |
| VR (%) | | | | 0.834 | | |
| Ratio[2] (%) | | | | 100 | | |
| Highest point attained (m) | | | | 24.3 | | |
| Carry (m) | | | | 216.9 | | |

[1]Values are rounded off to nearest thousandth of a millimeter.

[2]The proportion of the total number of dimples formed on the ball surface which are dimples that satisfy the conditions specified in the invention.

TABLE 3

| | | Comparative Example 1 | | | | |
|---|---|---|---|---|---|---|
| Dimple type | | No. 1 | No. 2 | No. 3 | No. 4 | No. 5 |
| Number of dimples | | 18 | 228 | 60 | 18 | 6 |
| Diameter (mm) | | 4.5 | 4.3 | 3.8 | 3.3 | 2.7 |
| Depth at point of maximum depth (mm) | | 0.125 | 0.140 | 0.140 | 0.125 | 0.130 |
| Average depths[1] | d1 (mm) | 0.052 | 0.058 | 0.058 | 0.052 | 0.054 |
| | d2 (mm) | 0.086 | 0.097 | 0.097 | 0.086 | 0.090 |
| | d3 (mm) | 0.110 | 0.123 | 0.123 | 0.110 | 0.114 |
| | d4 (mm) | 0.122 | 0.136 | 0.136 | 0.122 | 0.127 |
| | d5 (mm) | 0.124 | 0.139 | 0.139 | 0.124 | 0.129 |
| d1 ÷ d5 (%) | | 42 | 42 | 42 | 42 | 42 |
| d2 ÷ d5 (%) | | 69 | 69 | 69 | 69 | 69 |
| d3 ÷ d5 (%) | | 88 | 88 | 88 | 88 | 88 |
| d4 ÷ d5 (%) | | 98 | 98 | 98 | 98 | 98 |
| d1 ÷ d2 (%) | | 61 | 61 | 61 | 61 | 61 |
| VR (%) | | | | 0.837 | | |
| Ratio[2] (%) | | | | 0 | | |
| Highest point attained (m) | | | | 22.5 | | |
| Carry (m) | | | | 214.9 | | |

[1]Values are rounded off to nearest thousandth of a millimeter.

[2]The proportion of the total number of dimples formed on the ball surface which are dimples that satisfy the conditions specified in the invention.

TABLE 4

| | | Comparative Example 2 | | | | |
|---|---|---|---|---|---|---|
| Dimple type | | No. 1 | No. 2 | No. 3 | No. 4 | No. 5 |
| Number of dimples | | 18 | 228 | 60 | 18 | 6 |
| Diameter (mm) | | 4.5 | 4.3 | 3.8 | 3.3 | 2.7 |
| Depth at point of maximum depth (mm) | | 0.125 | 0.140 | 0.135 | 0.120 | 0.130 |
| Average depths[1] | d1 (mm) | 0.064 | 0.071 | 0.069 | 0.061 | 0.066 |
| | d2 (mm) | 0.083 | 0.093 | 0.090 | 0.080 | 0.086 |
| | d3 (mm) | 0.088 | 0.099 | 0.095 | 0.084 | 0.092 |
| | d4 (mm) | 0.109 | 0.122 | 0.118 | 0.105 | 0.114 |
| | d5 (mm) | 0.120 | 0.134 | 0.129 | 0.115 | 0.124 |
| d1 ÷ d5 (%) | | 53 | 53 | 53 | 53 | 53 |
| d2 ÷ d5 (%) | | 69 | 69 | 69 | 69 | 69 |
| d3 ÷ d5 (%) | | 74 | 74 | 74 | 74 | 74 |
| d4 ÷ d5 (%) | | 91 | 91 | 91 | 91 | 91 |
| d1 ÷ d2 (%) | | 77 | 77 | 77 | 77 | 77 |

TABLE 4-continued

| Dimple type | Comparative Example 2 | | | | |
|---|---|---|---|---|---|
| | No. 1 | No. 2 | No. 3 | No. 4 | No. 5 |
| VR (%) | | | 0.832 | | |
| Ratio[2)] (%) | | | 0 | | |
| Highest point attained (m) | | | 22.3 | | |
| Carry (m) | | | 215.4 | | |

[1)]Values are rounded off to nearest thousandth of a millimeter.

[2)]The proportion of the total number of dimples formed on the ball surface which are dimples that satisfy the conditions specified in the invention.

It is apparent from Tables 1 to 4 that, although the dimple spatial occupancy VR was about the same in the examples of the invention and the comparative examples, owing to differences in the cross-sectional shapes of the dimples, higher trajectories were obtained in Examples 1 and 2 than in Comparative Examples 1 and 2; that is, the highest point attained by the ball was from 1 to 2 m higher. As a result, the golf balls in Examples 1 and 2 had a greatly increased distance (carry) compared with the golf balls in Comparative Examples 1 and 2.

The invention claimed is:

1. A golf ball comprising a surface having a plurality of dimples formed thereon, wherein some or all of the dimples formed on the ball surface are dimples having a cross-sectional shape which, letting a straight line passing through any one edge of the dimple and a foot of a perpendicular (pedal) dropped from an imaginary plane defined by a peripheral edge of the dimple to a deepest point of the dimple serve as a reference line, establishing the following regions (1) to (5) on the reference line from the dimple edge as 0% (origin) to the pedal as 100%:

(1) 11% to 30%,
(2) 31% to 50%,
(3) 51% to 70%,
(4) 71% to 90%, and
(5) 81% to 100%, and letting the dimple have average depths d1 to d5 from the reference line in the respective regions (1) to (5), satisfies the following conditions:

$$d1 \div d5 = 25\% \text{ to } 100\%,$$

$$d2 \div d5 = 0\% \text{ to } 55\%,$$

$$d3 \div d5 = 60\% \text{ to } 100\%, \text{ and}$$

$$d1 \div d2 = 0\% \text{ to } 90\%.$$

2. The golf ball according to claim 1, wherein the dimples having cross-sectional shapes which satisfy said conditions account for at least 20% of the total number of dimples formed on the ball surface.

3. The golf ball according to claim 1 which has formed thereon two or more types of dimples of mutually differing diameter and/or depth.

* * * * *